US010644416B2

(12) United States Patent
Kanemura et al.

(10) Patent No.: US 10,644,416 B2
(45) Date of Patent: May 5, 2020

(54) CONNECTOR

(71) Applicant: Sumitomo Wiring Systems, Ltd., Yokkaichi, Mie (JP)

(72) Inventors: Keisuke Kanemura, Mie (JP); Shohei Mitsui, Mie (JP); Hidekazu Matsuda, Mie (JP); Yuichi Nakanishi, Mie (JP); Ai Hirano, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/231,668

(22) Filed: Dec. 24, 2018

(65) Prior Publication Data

US 2019/0199008 A1 Jun. 27, 2019

(30) Foreign Application Priority Data

Dec. 26, 2017 (JP) ..... 2017-248730

(51) Int. Cl.

| | |
|---|---|
| ***H01R 4/18*** | (2006.01) |
| ***H01R 13/639*** | (2006.01) |
| ***H01R 9/05*** | (2006.01) |
| ***H01R 13/50*** | (2006.01) |
| ***H01R 24/40*** | (2011.01) |
| ***H01R 13/436*** | (2006.01) |
| ***H01R 13/6582*** | (2011.01) |
| ***H01R 13/422*** | (2006.01) |
| ***H01R 13/11*** | (2006.01) |

(52) U.S. Cl.

CPC ..... *H01R 4/185* (2013.01); *H01R 9/05* (2013.01); *H01R 13/4223* (2013.01); *H01R 13/4362* (2013.01); *H01R 13/50* (2013.01); *H01R 13/639* (2013.01); *H01R 13/6582* (2013.01); *H01R 24/40* (2013.01); *H01R 9/0518* (2013.01); *H01R 13/111* (2013.01)

(58) Field of Classification Search

CPC ..... H01R 13/4362; H01R 9/0518; H01R 13/4223; H01R 13/4361; H01R 24/44; H01R 4/185; H01R 24/40; H01R 9/05; H01R 13/113

USPC ..... 439/52, 595, 585, 752.5, 394, 610

See application file for complete search history.

(56) References Cited

U.S. PATENT DOCUMENTS 5,041,021 A * 8/1991 Sato ..... H01R 9/0518 439/585

5,746,628 A * 5/1998 Yamamoto ..... H01R 13/4362 439/595

(Continued)

FOREIGN PATENT DOCUMENTS

JP 6235199 11/2017

*Primary Examiner* — Edwin A. Leon

*Assistant Examiner* — Matthew T Dzierzynski

(74) *Attorney, Agent, or Firm* — Gerald E. Hespos; Michael J. Porco; Matthew T. Hespos

(57) ABSTRACT

A connector (C) includes a housing (60), a terminal fitting (10) and a retainer (80). The housing (60) includes a cavity (64) extending in a front-rear direction and a retainer insertion hole (72) intersecting and communicating with the cavity and open in an outer surface. The terminal fitting (10) is inserted into the cavity (64) from behind, and a stabilizer configured to guide an inserting operation into the cavity (64) and restrict the inserting operation in an erroneous posture projects on an outer side. The retainer (80) is inserted into the retainer insertion hole (72) and include a retaining portion (85) configured to face the stabilizer from behind.

8 Claims, 12 Drawing Sheets

(56) References Cited

U.S. PATENT DOCUMENTS

| | | | | |
|---|---|---|---|---|
| 6,384,335 | B1 * | 5/2002 | Saito | H01R 9/0518 174/74 R |
| 6,769,934 | B2 * | 8/2004 | Nakamura | H01R 13/4223 439/595 |
| 6,808,417 | B2 * | 10/2004 | Yoshida | H01R 9/0518 439/585 |
| 6,811,451 | B2 * | 11/2004 | Mase | H01R 13/4362 439/595 |
| 7,182,652 | B2 * | 2/2007 | Yamakado | H01R 13/4362 439/752 |
| 7,204,725 | B2 * | 4/2007 | Yamashita | H01R 13/4362 439/752 |
| 7,204,726 | B2 * | 4/2007 | Yamashita | H01R 13/4362 439/752 |
| 7,445,524 | B2 * | 11/2008 | Horiuchi | H01R 13/4361 439/752 |
| 7,632,144 | B2 * | 12/2009 | Sakaguchi | H01R 9/0518 439/585 |
| 8,414,329 | B2 * | 4/2013 | Morikawa | H01R 4/185 439/578 |
| 8,512,075 | B2 * | 8/2013 | Sakamoto | H01R 13/4361 439/595 |
| 8,834,201 | B2 * | 9/2014 | Miyawaki | H01R 4/184 439/585 |
| 8,951,066 | B2 * | 2/2015 | Glick | H01R 13/426 439/595 |
| 9,306,311 | B2 * | 4/2016 | Kitajima | H01R 13/4362 |
| 9,306,326 | B2 * | 4/2016 | Nishiyama | H01R 24/76 |
| 9,450,352 | B2 * | 9/2016 | Miyawaki | H01R 24/44 |
| 2013/0171873 | A1 * | 7/2013 | Kanda | H01R 13/6581 439/607.51 |
| 2015/0214658 | A1 | 7/2015 | Nishiyama et al. | |

* cited by examiner

CONNECTOR

BACKGROUND

Field of the Invention

The invention relates to a connector.

Related Art

Japanese Patent No. 6235199 discloses a connector with a connector housing, a terminal and a retainer. The connector housing includes a terminal accommodation chamber and a retainer insertion hole intersecting and communicating with the terminal accommodation chamber. The terminal is composed of a mating terminal connecting portion and a wire connecting portion that are joined by a linking portion.

The retainer is inserted into the retainer insertion hole and is movable from a terminal insertion allowance position to a terminal connection position. In assembling, the retainer is set at the terminal insertion allowance position and the terminal is inserted into the terminal accommodation chamber. The terminal is retained in the terminal accommodation chamber primarily by being locked by a flexible locking lance of the connector housing. The retainer then is moved from the terminal insertion allowance position to the terminal connection position. At the terminal connection position, a terminal locking protrusion of the retainer comes into contact with a rear wall of the mating terminal connecting portion so that the terminal is retained secondarily in the terminal accommodation chamber.

The terminal locking protrusion of the retainer enters a space behind the rear wall of the mating terminal connecting portion and above the linking portion in the terminal. However, this space is in a recessed part dropped from the mating terminal connecting portion. Thus, a current may not flow smoothly, and this configuration is difficult to apply to terminal fittings that must have electrical reliability, such as high frequency performance.

The present invention was completed on the basis of the above situation and aims to provide a connector capable of enhancing electrical reliability.

SUMMARY

The invention is directed to a connector with a housing including a cavity extending in a front-rear direction. A retainer insertion hole is open in an outer surface of the housing so that the retainer insertion hole intersects and communicates with the cavity. A terminal fitting is inserted into the cavity from behind. A stabilizer projects out from the terminal fitting. The stabilizer guides the terminal fitting into the cavity and restricts insertion in an erroneous posture. A retainer is inserted into the retainer insertion hole and includes a retaining portion configured to face the stabilizer from behind. Therefore, the retaining portion prevents the terminal fitting from moving rearward out of the cavity. The stabilizer projects out on the terminal fitting. Thus, the flow of current is ensured and electrical reliability is enhanced as compared to the case where the terminal fitting is formed with recess. Further, the stabilizer has a function of guiding the insertion of the terminal fitting and a function of restricting erroneous insertion. Accordingly, the terminal fitting is less complex than a terminal fitting that separate parts for these two functions.

The housing may include a deflectable and deformable locking lance on a wall surface of the cavity, and the stabilizer may include a first stabilizer facing the retaining portion. The stabilizer may be a first stabilizer, and a second stabilizer may face the locking lance from behind. Normally, a terminal fitting is provided with a lance hole for receiving a locking lance in a tubular mating connecting portion. However, a lance hole impedes a flow of current. Accordingly, the terminal fitting is locked primarily by the locking lance facing the second stabilizer from behind. Thus, the lance hole need not be provided in the mating connecting portion and electrical reliability can be enhanced.

The first stabilizer may be longer than the second stabilizer in a front-rear direction. Accordingly, sufficient strength to receive a locking force of the retainer can be ensured. Further, the second stabilizer need not be as strong as the first stabilizer and can be shorter. Thus, the structure of the terminal fitting can be identified and the second stabilizer can conform to the formation position of the locking lance on the side of the housing.

A projecting direction of the stabilizer may intersect an inserting direction of the retainer into the retainer insertion hole. According to this configuration, if a height direction of the housing is set to be the inserting direction of the retainer into the retainer insertion hole, a guiding groove for guiding the stabilizer in the housing faces in a direction intersecting the height direction. Thus, a height reduction of the housing can be realized. Further, since the retaining portion intersects the stabilizer and is locked to the stabilizer, a locked state can be maintained satisfactorily.

The terminal fitting may include an inner conductor having a mating connecting portion to be connected to a mating terminal fitting and a center conductor crimping portion to be crimped to a center conductor of a shielded cable. An outer conductor may have a tubular portion configured to surround the mating connecting portion and a shield crimping portion to be crimped to a shield layer of the shielded cable, and the stabilizer may be provided at a position separated from the tubular portion on the outer conductor. According to this configuration, a shield current can flow satisfactorily without being affected by the stabilizer and high frequency performance of the shielded cable can be improved.

The outer conductor may include a coupling, and the center conductor crimping portion may be disposed inside the coupling. The stabilizer may project on the coupling, and a cover configured to electrically contact the outer conductor while covering the center conductor crimping portion may be disposed in a space inside the coupling. According to this configuration, the shield current can flow satisfactorily through the cover also in a part corresponding to the coupling and high frequency performance can be improved.

DETAILED DESCRIPTION

One embodiment is described with reference to FIGS. 1 to 11. A connector C according to this embodiment includes a terminal fitting 10, a housing 60 for accommodating the terminal fitting 10 and a retainer 80 to be mounted movably into the housing 60. The housing 60 is connectable to an unillustrated mating housing. Note that, in the following description, a side of the housing 60 facing the mating housing at the start of connection is referred to as a front concerning a front-rear direction. A vertical direction is based on figures except FIGS. 7 and 11.

Figure 1:
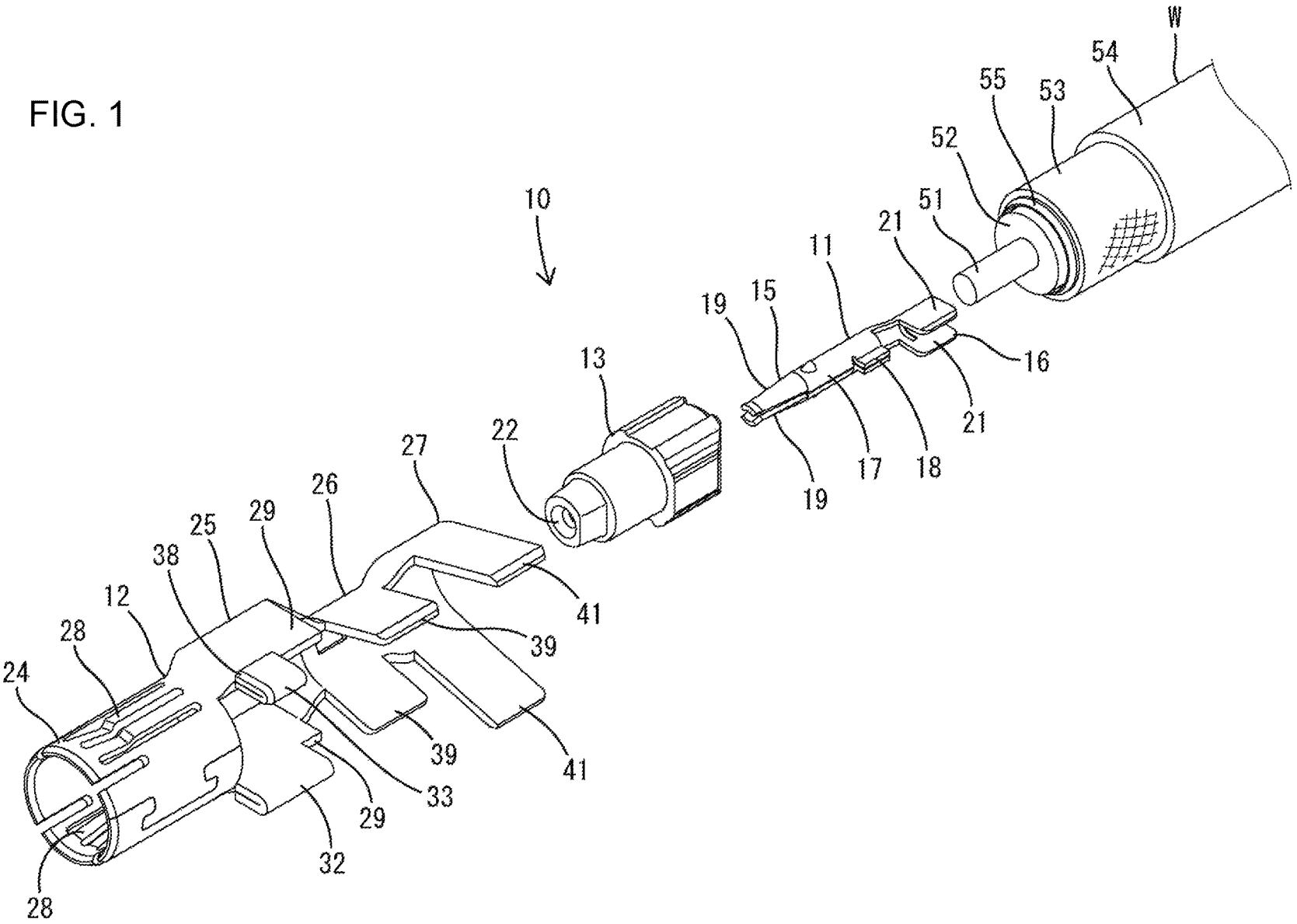
FIG. 1 is an exploded perspective view of a terminal fitting in one embodiment of the invention.
Figure 2:
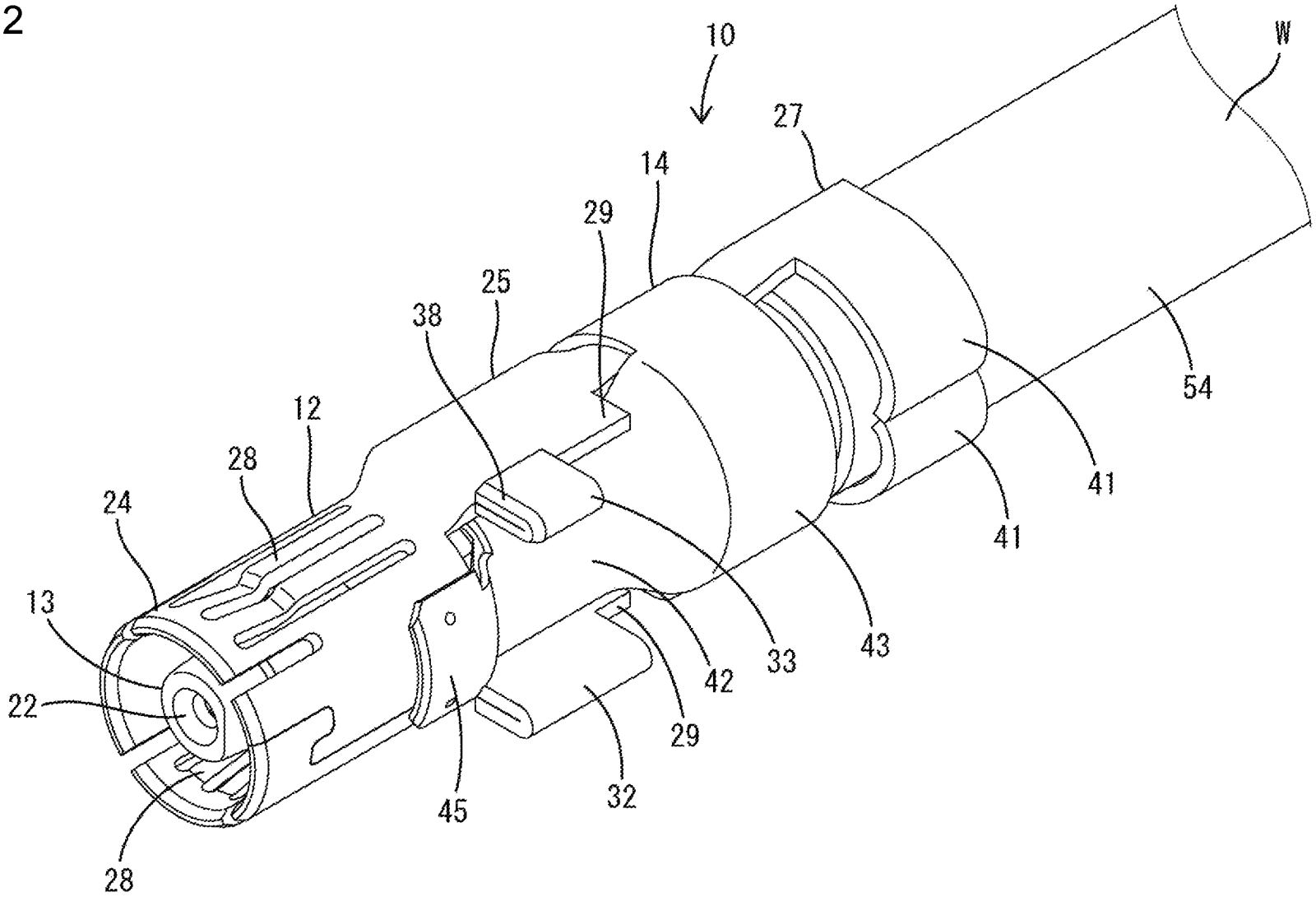
FIG. 2 is a perspective view of the terminal fitting.

As shown in FIG. 2, the terminal fitting 10 is connected to an end part of a shielded cable W and includes an inner conductor 11 (see FIG. 1), an outer conductor 12, a dielectric 13 and a cover 14. The inner conductor 11, the outer conductor 12 and the cover 14 are made of a conductive metal, and the dielectric 13 is made of an insulating synthetic resin.

As shown in FIG. 1, the shielded cable W is a so-called coaxial cable and includes a conductive core 51 (center conductor) formed by twisting strands, an insulating coating 52 surrounding the outer periphery of the core 51, a conductive braided wire 53 (shield layer) surrounding the coating 52 and formed by weaving strands into a net and an insulating sheath 54 surrounding the outer periphery of the braided wire 53. The core 51 has a function of transmitting a high-frequency signal and the braided wire 53 has a function of shielding electromagnetic waves. The shielded cable W has the sheath 54 and the coating 52 stripped successively to expose the core 51 and the braided wire 53 from a tip side. A sleeve 55 for receiving a crimping load is inserted between the coating 52 and the braided wire 53.

Figure 8:
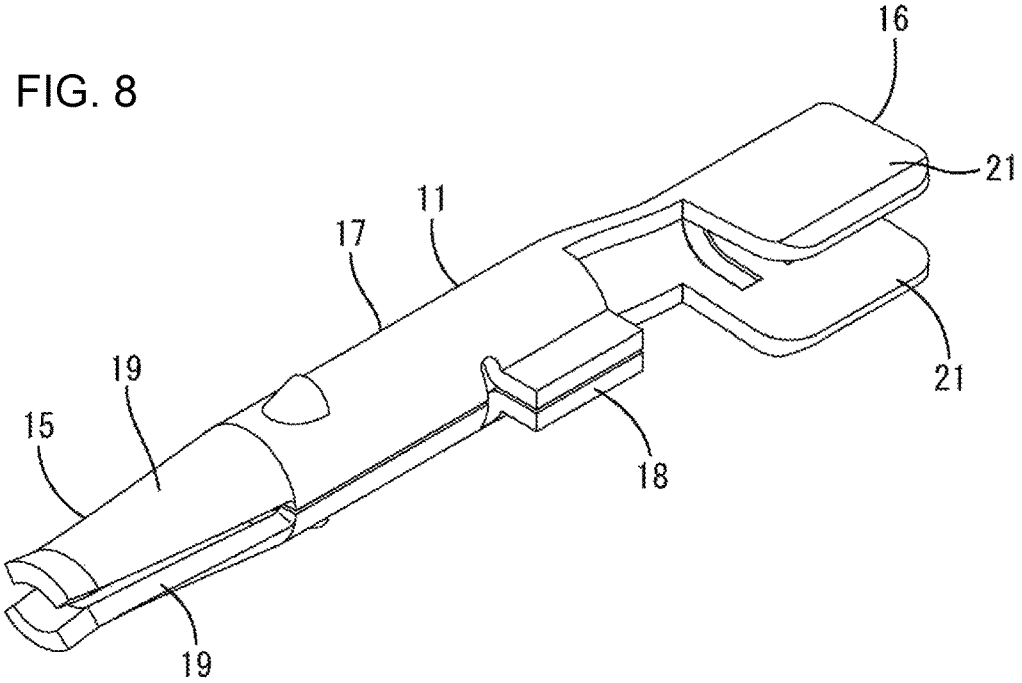
FIG. 8 is a perspective view of an inner conductor.

The inner conductor 11 is long and narrow in the front-rear direction and may be formed by bending a metal plate. The inner conductor 11 includes a mating connecting portion 15 on a front end, a center conductor crimping portion 16 on a rear end and a tubular portion 17 between the mating connecting portion 15 and the center conductor crimping portion 16, as shown in FIG. 8. The tubular portion 17 includes a contact stop 18 projecting toward one lateral side.

The mating connecting portion 15 is composed of two resilient pieces 19 projecting forward from the tubular portion 17. The resilient pieces 19 are arranged to face each other across a slit extending in the front-rear direction. A tab of an unillustrated mating terminal fitting is inserted between the resilient pieces 19 when the housings are connected, and the resilient pieces 19 resiliently contact the tab so that the terminal fitting 10 is connected electrically to the mating terminal fitting.

The center conductor crimping portion 16 includes two laterally projecting center conductor crimping pieces 21 that form of an open barrel. The center conductor crimping pieces 21 are crimped and connected to the core 51 of the shielded cable W.

Figure 11:
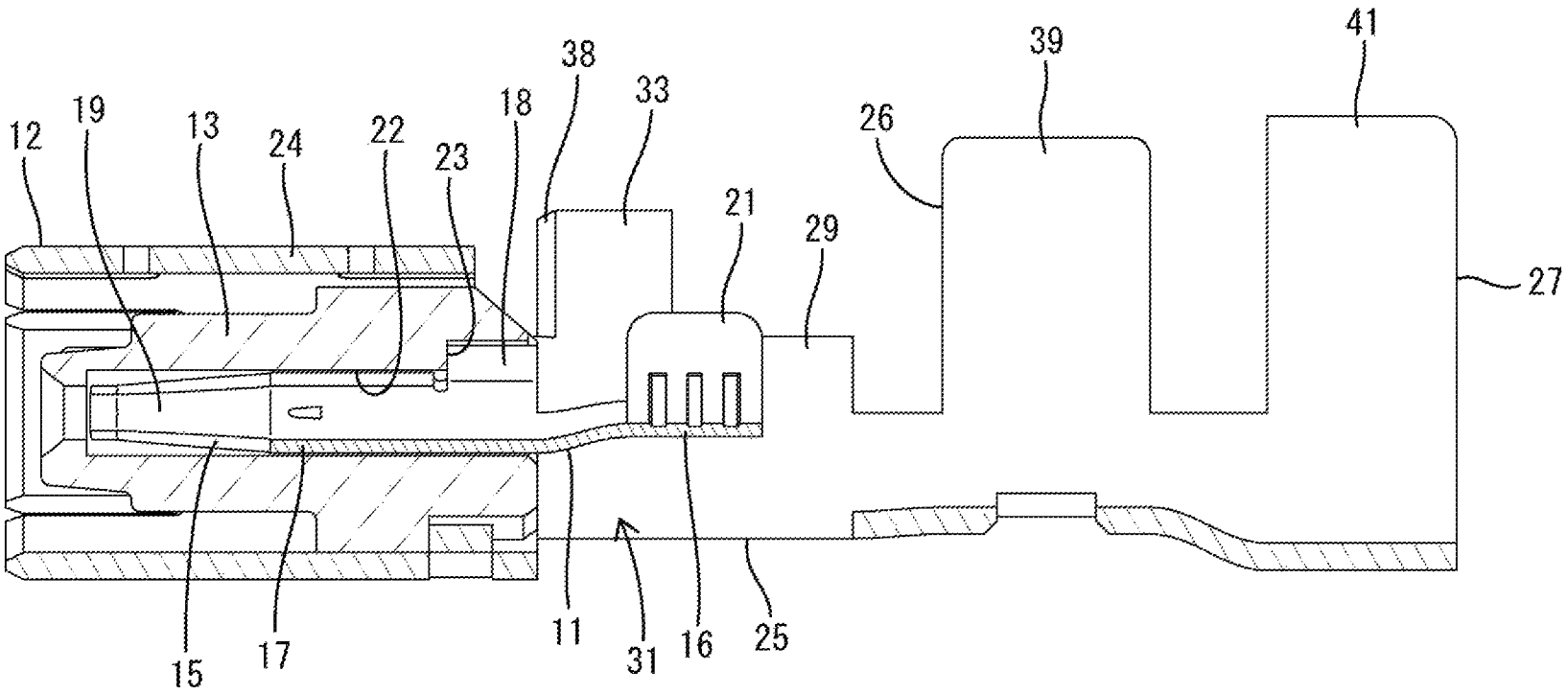
FIG. 11 is a section showing the state where the dielectric assembled with the inner conductor is inserted in the tubular portion of the outer conductor.

As shown in FIG. 1, the dielectric 13 has a substantially hollow cylindrical shape and includes an inner conductor insertion hole 22. As shown in FIG. 11, a recessed contact stop receiving portion 23 is provided by cutting a rear part of the inner surface of the inner conductor insertion hole 22. The inner conductor 11 is inserted into the inner conductor insertion hole 22 of the dielectric 13. The inner conductor 11 is stopped in front by the contact stop 18 entering the contact stop receiving portion 23 and contacting the front end of the contact stop receiving portion 23.

Figure 9:
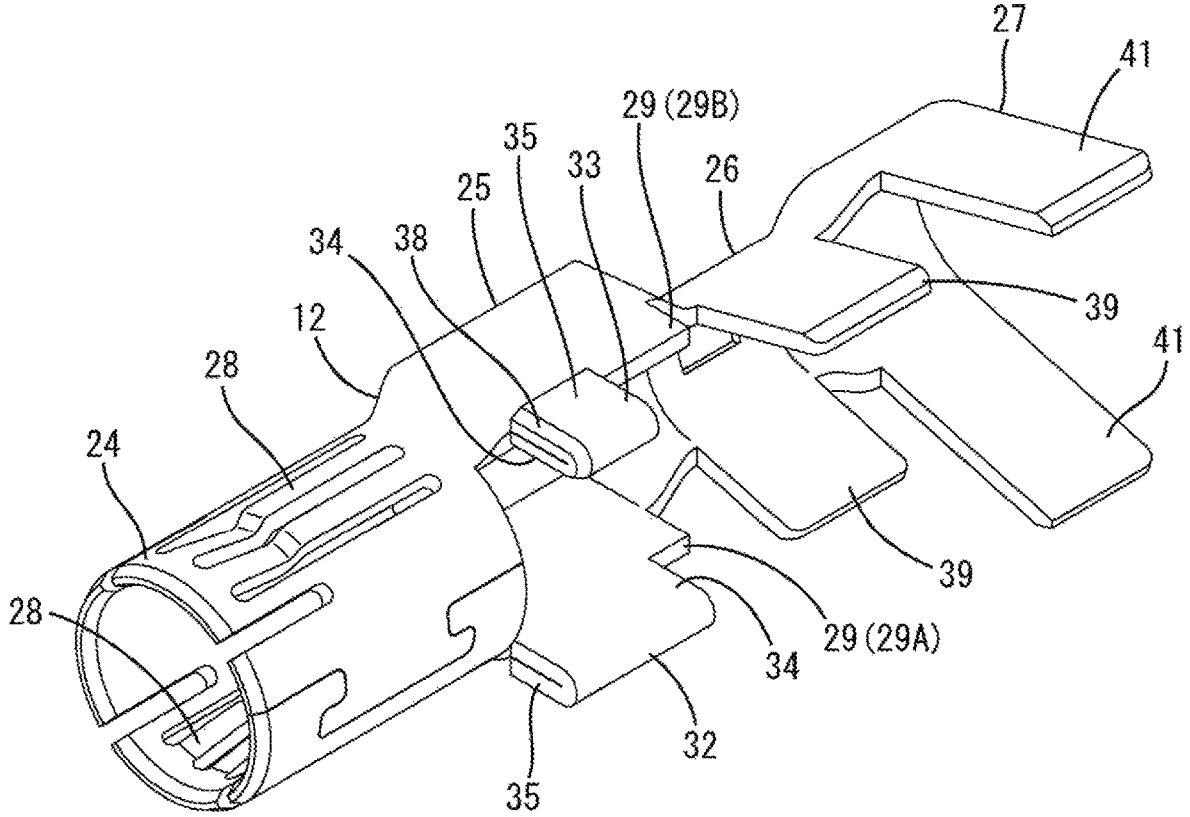
FIG. 9 is a perspective view of an outer conductor.

The outer conductor 12 is one size larger than the inner conductor 11 and is formed by bending a metal plate to define a tubular portion 24, a coupling 25, a shield crimping portion 26 and a sheath crimping portion 27 from the front to the rear, as shown in FIG. 9.

Figure 10:
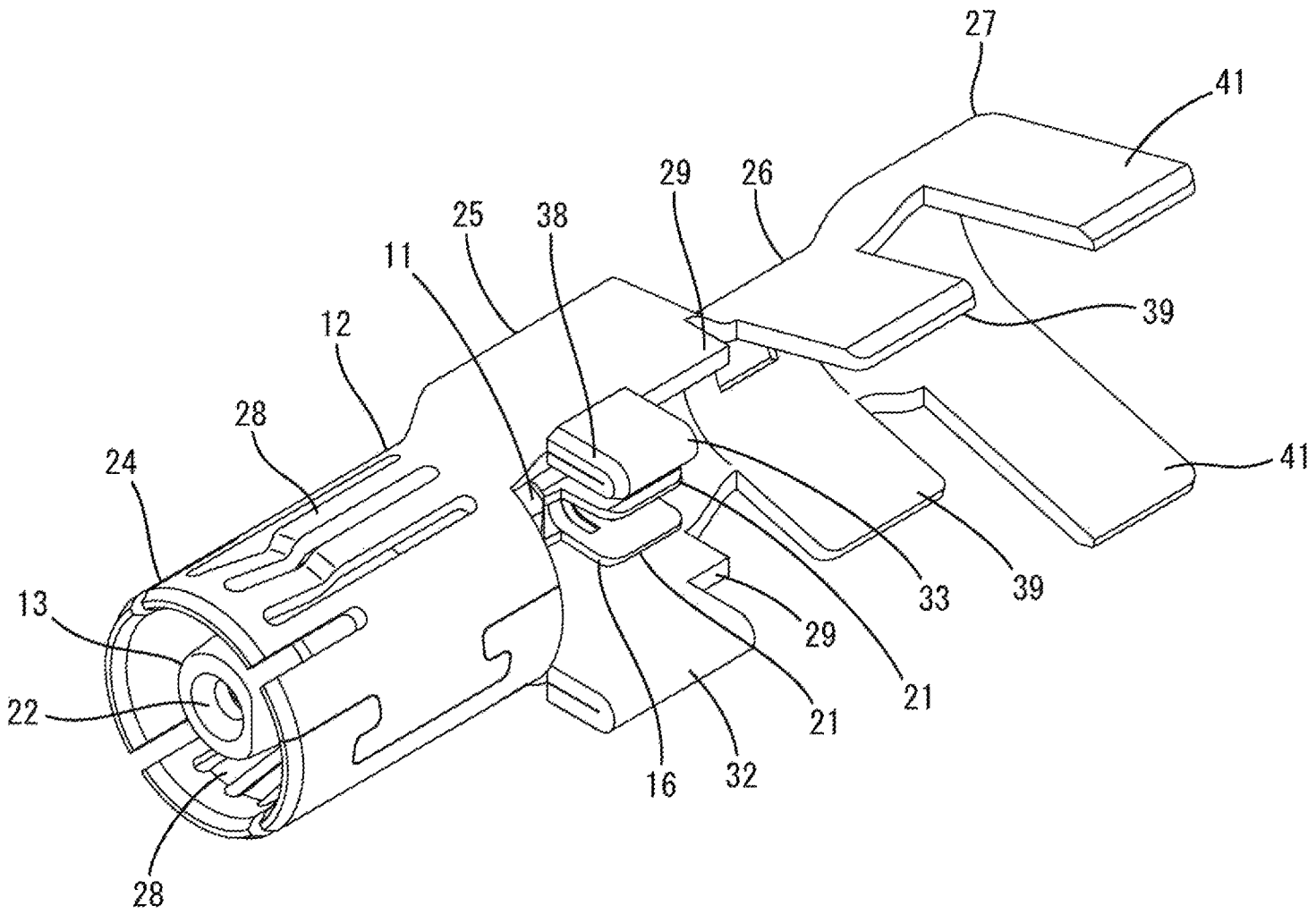
FIG. 10 is a perspective view showing a state where a dielectric assembled with the inner conductor is inserted in a tubular portion of the outer conductor.

The tubular portion 24 has a circular cross-section and is held in a closed state by meshing projecting and recessed butting ends. As shown in FIG. 10, the dielectric 13 is inserted and held in the tubular portion 24. The tubular portion 24 includes two shield contact pieces 28. Each shield contact piece 28 is provided between slits in the tubular portion 24 that extend parallel to the front-rear direction. The shield contact pieces 28 are deflectable with both front and rear ends as supports. Further, each shield contact piece 28 is bent to project into the tubular portion 24 and resiliently contacts an outer conductor of the unillustrated mating terminal fitting. Note that the tubular portion 24 is not provided with any large open part, such as a lance hole.

The coupling 25 includes two side walls 29 connected to the rear ends of side parts of the tubular portion 24. The side walls 29 are rectangular plates, connected to side parts of the tubular portion 24 across the butting ends and face substantially in parallel along the front-rear direction. A space defined between the side walls 29 and between the tubular portion 24 and the shield crimping portion 26 is open toward both sides (vertical direction of FIG. 11) to define an opening 31. Unillustrated crimping tools (anvil, crimper) for the center conductor crimping portion 16 of the inner conductor 11 are inserted into the opening 31. The opening 31 enables the center conductor crimping portion 16 to be crimped to the core 51 of the shielded cable W after the inner conductor 11 is set in the outer conductor 12.

The coupling 25 includes a first stabilizer 32 projecting toward one lateral side from an end edge of the lower side wall 29A of FIG. 9 and a second stabilizer 33 projecting toward the lateral side from an end edge of the upper side wall 29B of FIG. 9.

As shown in FIG. 9, each of the first and second stabilizers 32, 33 is composed of an inner plate 34 projecting continuously from and flush with a wall surface of the one or other side wall 29 and an outer plate 35 folded toward the other side wall 29 from a projecting end of the inner plate 34 and facing the outer surface of the inner plate 34 while being held substantially in close contact with this outer surface. Thus, each of the first and second stabilizers 32, 33 has double inner and outer rectangular plates composed of the inner plate 34 and the outer plate 35, and is thicker than the side walls 29.

Figure 3:
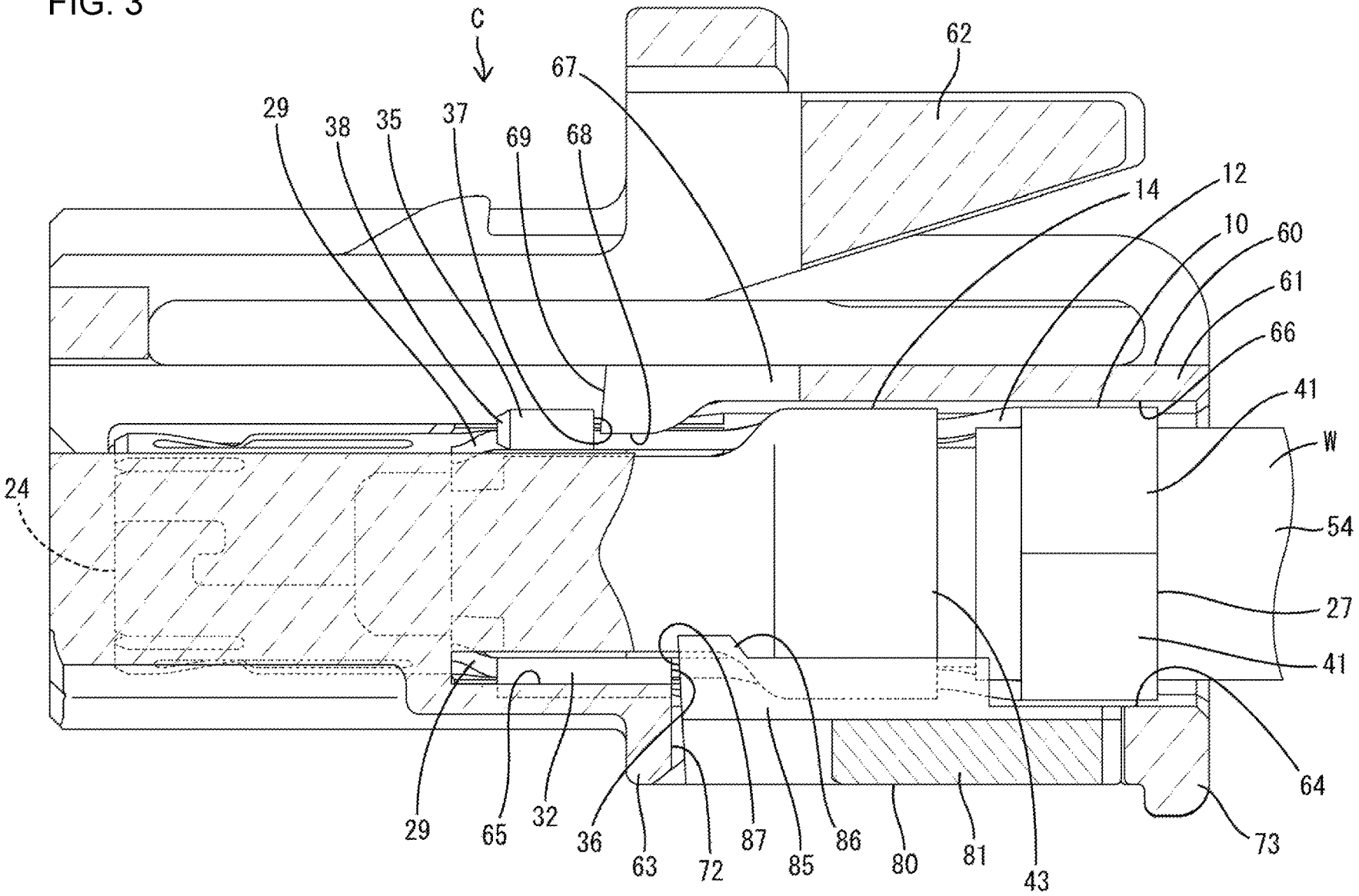
FIG. 3 is a section showing a state where a retaining portion of a retainer faces a first stabilizer from behind, a locking projection of a locking lance is arranged to face a second stabilizer from behind and the terminal fitting is retained in a cavity of a housing.

As shown in FIG. 3, the respective rear ends (plate thickness parts) of the first and second stabilizers 32, 33 serve as first and second lock receiving surfaces 36, 37 flat and long in a direction substantially perpendicular to the front-rear direction. Further, a length of the first stabilizer 32 in the front-rear direction is longer than that of the second stabilizer 33 in the front-rear direction. The respective front ends of the first and second stabilizers 32, 33 are aligned substantially at the same position, and the first lock receiving surface 36 is located behind the second lock receiving surface 37.

The front end of the second stabilizer 33 has a chamfered surface 38 with edges from the inner plate 34 and the outer plate 35 chamfered. On the other hand, the front end of the first stabilizer 32 is substantially at a right angle without a chamfer.

The shield crimping portion 26 is an open barrel formed by two shield crimping pieces 39 connected to the rear ends of the side walls 29 and projecting in the same direction as the first and second stabilizers 32, 33. The shield crimping pieces 39 are crimped and connected to the braided wire 53 of the shielded cable W.

The sheath crimping portion 27 is an open barrel formed by two sheath crimping pieces 41 projecting in the same direction as the first and second stabilizers 32, 33 and the shield crimping pieces 39. The sheath crimping pieces 41 are crimped and connected to the sheath 54 of the shielded cable W. The first and second stabilizers 32, 33, the shield crimping pieces 39 and the sheath crimping pieces 41 are arranged one after another in the front-rear direction while projecting toward the one lateral side in the same direction.

Figure 13:
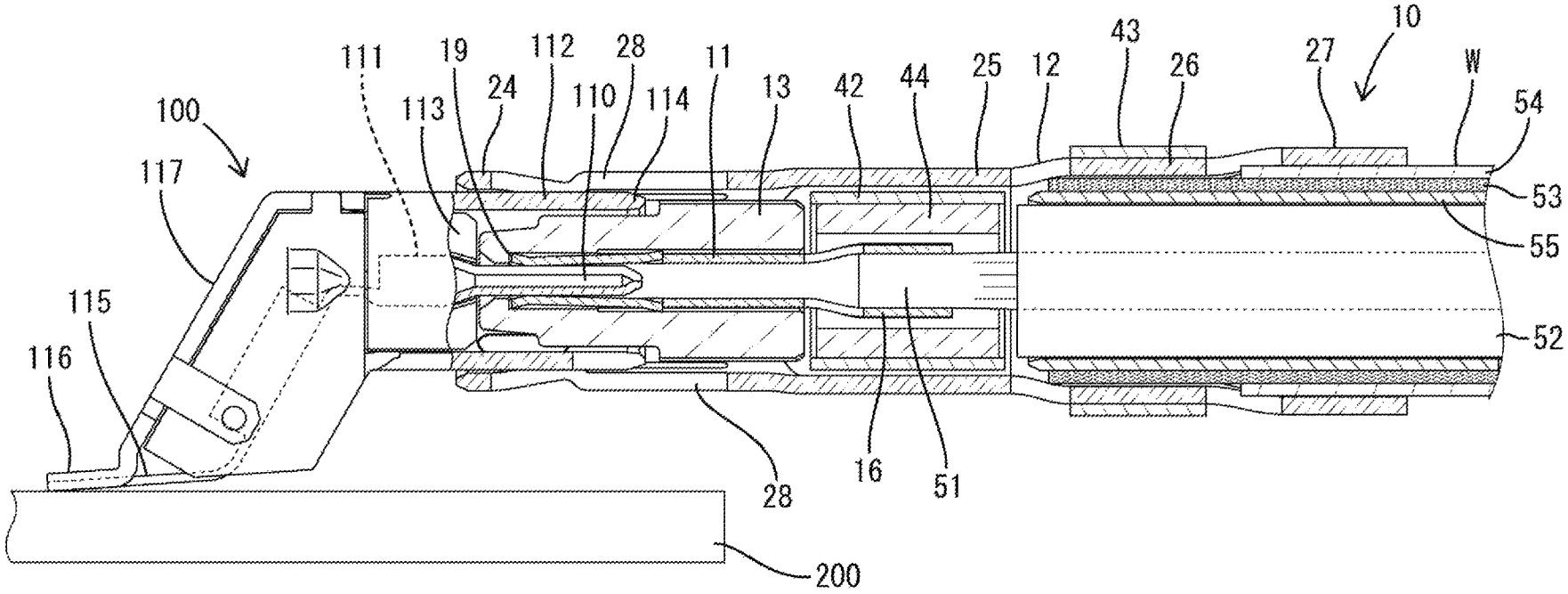
FIG. 13 is a section showing the state where the terminal fitting is connected to the mating terminal fitting on the printed circuit board in the reference example.

As shown in FIG. 2, the cover 14 includes an inner conductor-side surrounding portion 42 to be inserted between the side walls 29 of the coupling 25 and a shield-side surrounding portion 43 for surrounding the outer periphery of the shield crimping portion 26. The inner conductor-side surrounding portion 42 is bent to surround the outer periphery of the center conductor crimping portion 16 by an uillustrated tool. An insulating surrounding portion 44 (see FIG. 13 showing a reference example to be described later) is between the inner conductor-side surrounding portion 42 and the center conductor crimping portion 16.

The shield-side surrounding portion 43 is bent to have a circular cross-sectional shape to extend along the outer periphery of the shield crimping portion 26, and is locked to the shield crimping portion 26. This shield-side surrounding portion 43 restricts inadvertent expansion of the shield crimping portion 26 gently crimped to the braided wire 53.

The cover 14 includes a connecting piece 45 projecting forward from the inner conductor-side surrounding portion 42. The connecting piece 45 is supported in contact with the outer peripheral surface of the tubular portion 24.

The cover 14 is so arranged that the contact piece 45 contacts the tubular portion 24, the shield-side surrounding portion 43 contacts the shield crimping portion 26 and the inner conductor-side surrounding portion 42 covers the opening 31 of the coupling 25 to ensure a good flow of a shield current even at a position corresponding to the coupling 25. The insulating surrounding portion 44 between the inner conductor-side surrounding portion 42 and the center conductor crimping portion 16 prevents a short circuit between the inner conductor 11 and the outer conductor 12.

Figure 4:
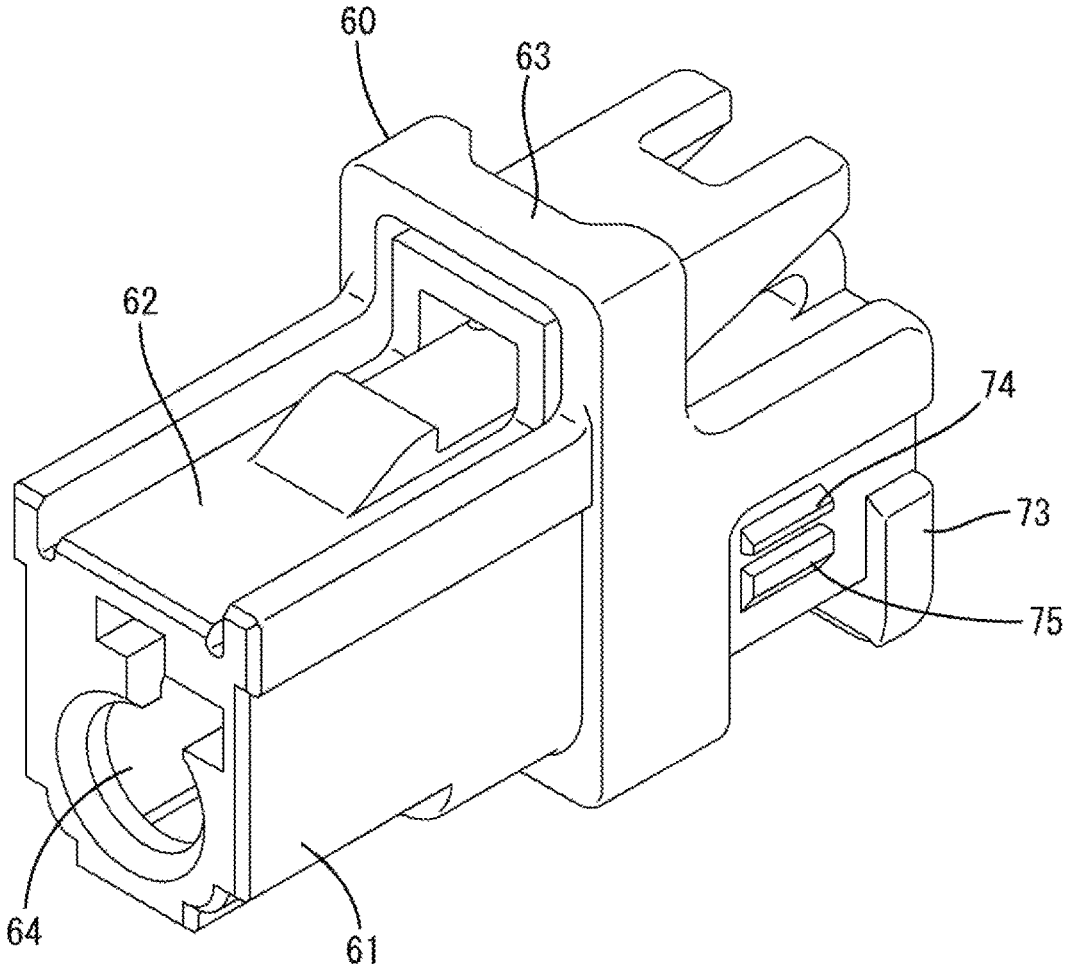
FIG. 4 is a perspective view of the housing.

The housing 60 is made of synthetic resin and includes, as shown in FIG. 4, a housing body 61 having a tubular shape long in the front-rear direction. A deflectable lock arm 62 is provided on the upper surface of the housing body 61 and an annular portion 63 is provided circumferentially on the housing body 61 while covering upper and both lateral sides of a rear part of the lock arm 62. The lock arm 62 functions to hold the housings in a connected state by resiliently locking a lock of the unillustrated mating housing.

Figure 5:
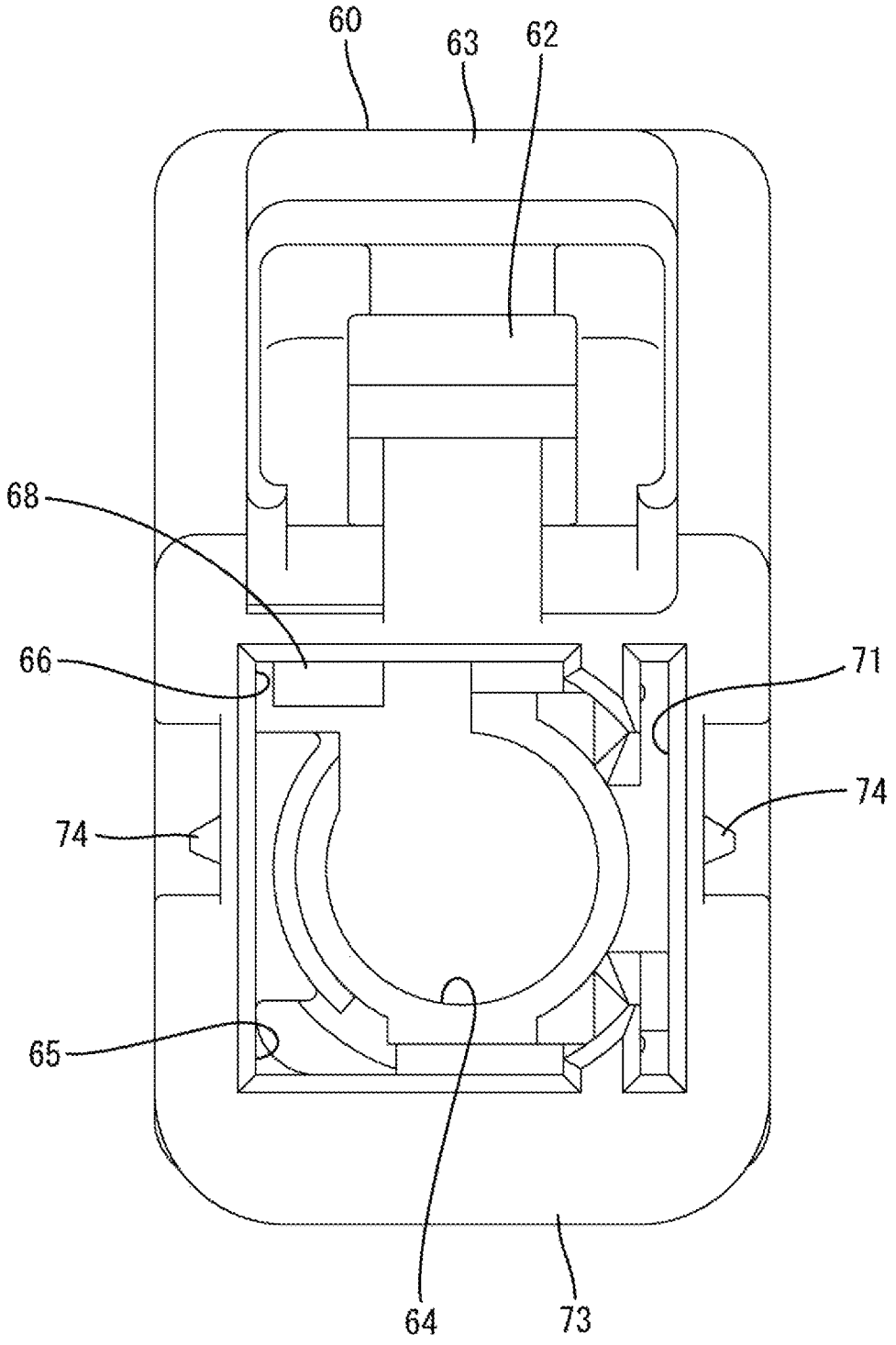
FIG. 5 is a back view of the housing.

A cavity 64 penetrates the housing body 61 in the front-rear direction, and first and second guiding grooves 65, 66 extend in the front-rear direction while communicating with the cavity 64, as shown in FIG. 5. The terminal fitting 10 is inserted into the cavity 64 of the housing body 61 from behind.

A front part of the cavity 64 of the housing body 61 has a circular cross-sectional shape, and the tubular portion 24 of the outer conductor 12 is fit and inserted therein.

As shown in FIG. 3, the housing body 61 includes a locking lance 67 cantilevered forward from the upper wall of the cavity 64. As shown in FIG. 5, the locking lance 67 is provided eccentrically toward one lateral side with respect to a lateral center of the cavity 64. As shown in FIG. 3, the locking lance 67 includes a locking projection 68 projecting into the cavity 64 on a front end part. The front surface of the locking projection 68 serves as an overhanging second locking surface 69 long in the vertical direction and inclined with respect to the vertical direction so that a projecting end side (lower end side) protrudes forward.

The first guiding groove 65 has a front end closed at an intermediate position of the housing body 61 in the front-rear direction and a rear end open in the rear surface of the housing body 61. The second guiding groove 66 has a front end facing the locking projection 68 of the locking lance 67 and a rear end open in the rear surface of the housing body 61. As shown in FIG. 5, the locking projection 68 can be seen from behind through the second guiding groove 66.

The first and second guiding grooves 65, 66 are recessed toward one lateral side (direction intersecting (perpendicular to) the vertical direction) from lower and upper parts of the cavity 64 in the housing body 61. The first stabilizer 32 is inserted into the first guiding groove 65 from behind, the second stabilizer 33 is inserted into the second guiding groove 66.

The housing body 61 includes a grounding member insertion hole 71 communicating with the cavity 64 from a side opposite to the first and second guiding grooves 65, 66. The grounding member insertion hole 71 is a slit extending in the vertical direction and open in the rear surface of the housing body 61. An unillustrated grounding member is inserted into the grounding member insertion hole 71 of the housing body 61 from behind.

As shown in FIG. 3, a retainer insertion hole 72 is open in a lower surface of the housing body 61 and perpendicularly intersects and communicates with the cavity 64. The retainer insertion hole 72 is provided in a rear part of the housing body 61, an opening edge part on a front end is closed by the annular portion 63, and an opening edge part on a rear end is closed by a rear rib 73 facing the annular portion 63. The front end of the retainer insertion hole 72 is at a position overlapping the locking projection 68 of the locking lance 67 in the front-rear direction.

As shown in FIG. 4, the housing body 61 includes full holding portions 74 and part holding portions 75 arranged in parallel in the vertical direction on both outer left and right surfaces of the rear part. Each of the full holding portions 74 and the part holding portions 75 is a rib extending in the front-rear direction and is located between the annular portion 63 and the rear rib 73 in the front-rear direction.

Figure 6:
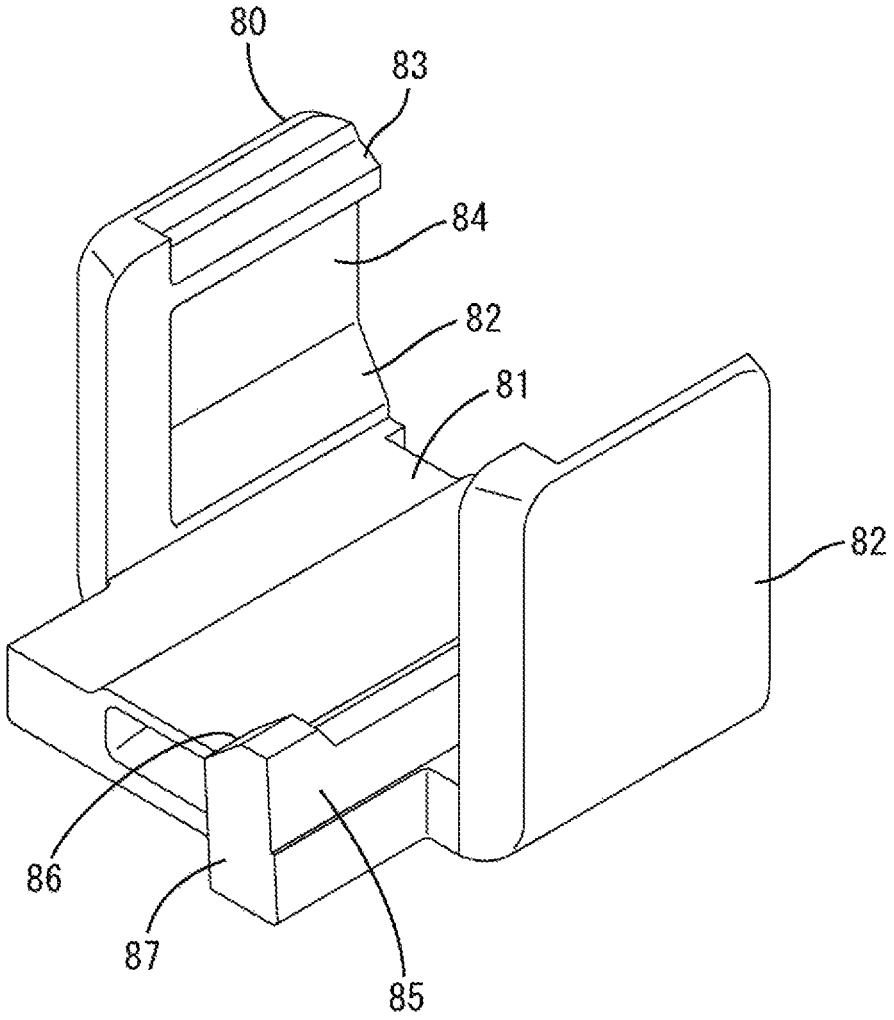
FIG. 6 is a perspective view of the retainer.
Figure 7:
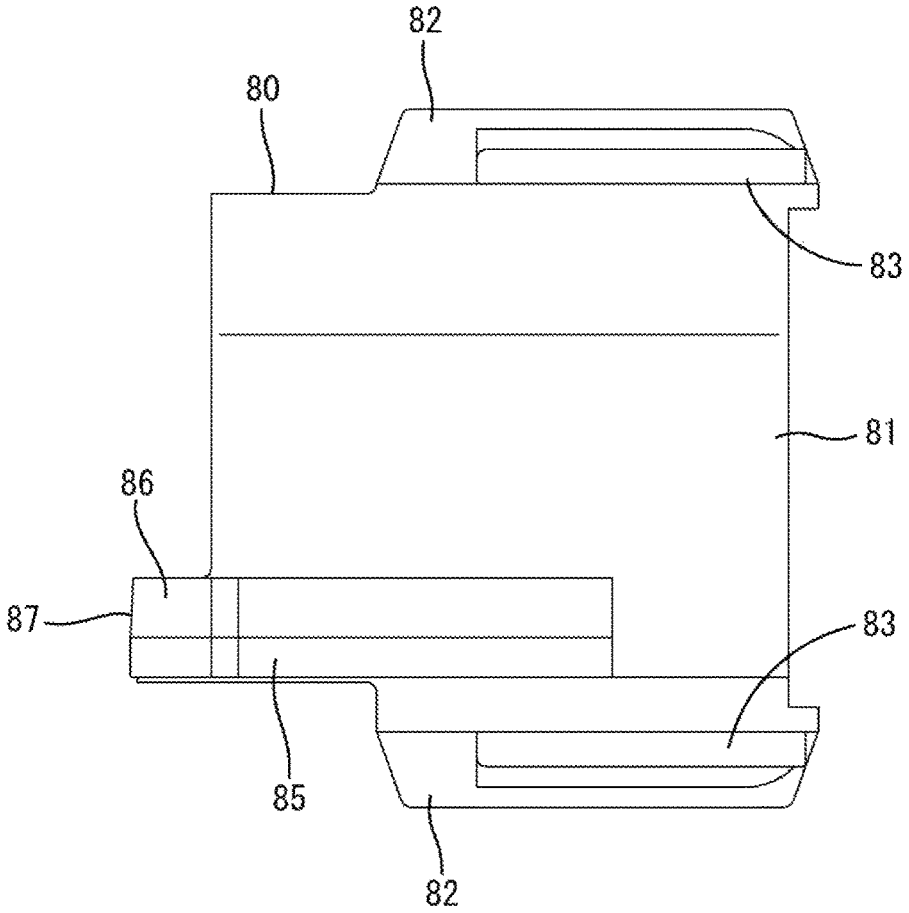
FIG. 7 is a plan view of the retainer.

The retainer 80 is made of synthetic resin and includes, as shown in FIGS. 6 and 7, a retainer body 81 in the form of a flat rectangular plate and two side plates 82 in the form of flat rectangular plates rising from both left and right ends of the retainer body 81. When the retainer 80 is mounted into the housing 60, the retainer body 81 closes a lower end opening of the retainer insertion hole 72 and the side plates 82 cover both outer side surfaces in the rear part of the housing body 61.

The side plates 82 include holding ribs 83 on upper end parts of inner surfaces. Each holding rib 83 extends in the front-rear direction and has a lower end defined by a recess 84 provided in the inner surface of the side plate 82. The side plates 82 are deflectable with base end parts on the side of the retainer body 81 as supports.

The retainer 80 includes a retaining rib 85 projecting up on one lateral part of the retainer body 81 and extending in the front-rear direction. The retaining rib 85 projects forward from the front end of the retainer body 81 and has a rear part integral with the side plate 82 on one side along the front-rear direction. As shown in FIG. 6, a part of the retaining rib 85 projecting forward from the front end of the retainer body 81 serves as a retaining body 86 that is thicker than a rear part. As shown in FIG. 3, the front surface of the retaining body 86 defines an overhanging first locking surface 87 long in the vertical direction and inclined with respect to the vertical direction so that a projecting upper end protrudes forward.

The retainer 80 is mounted into the rear part of the housing body 61 from below. After the both side plates 82 are deflected and deformed. The holding ribs 83 are inserted and held between the part holding portions 75 and the full holding portions 74 of the housing body 61 to hold the retainer 80 at a partial locking position. Further, after the retainer 80 is pushed up from the partial locking position and the side plate portions 82 are deflected, the lower ends of the holding ribs 83 contact the full holding portions 74 to be supported and to hold the retainer 80 at a full locking position with respect to the housing 60.

Next, assembly structure of the connector C is described. The retainer 80 is held at the partial locking position with respect to the housing 60 and, in that state, the terminal fitting 10 is inserted into the cavity 64 of the housing 60 from behind in a horizontal posture so that the first and second stabilizers 32, 33 are facing one lateral side. In the process of inserting the terminal fitting 10 into the cavity 64, the first and second stabilizers 32, 33 respectively slide on surfaces of the first and second guiding grooves 65, 66 to guide an insertion of the terminal fitting 10. Further, the retaining portion 85 is retracted from the first guiding groove 65 when the retainer 80 is at the partial locking position. Thus, the first stabilizer 32 does not interfere with the retaining portion 85 is avoided.

On the other hand, if it is attempted to insert the terminal fitting 10 in an improper (e.g. inverted) posture into the cavity 64 of the housing 60, the first and second stabilizers 32, 33 contact with the rear surface of the housing 60 to stop the insertion of the terminal fitting 10. Thus, the terminal fitting 10 cannot be inserted into the cavity 64 in the improper posture.

In the process of inserting the terminal fitting 10 into the cavity 64, the second stabilizer 33 contacts the locking lance 67 and the locking lance 67 is pressed by the second stabilizer 33 to deflect and deform. At this time, the chamfered surface 38 of the second stabilizer 33 contacts the locking lance 67 to prevent damage to the locking lance 67.

When the terminal fitting 10 is inserted properly into the cavity 64, the locking lance 67 resiliently returns and the second locking surface 69 of the locking projection 68 faces and locks to the second lock receiving surface 37 from behind (see FIG. 3). A projecting direction of the second stabilizer 33 and a deflecting direction of the locking lance 67 intersect (are perpendicular to) each other. Thus, the second locking surface 69 of the locking projection 68 can lock the second lock receiving surface 37 in a long range extending substantially over the entire length along a forming direction (direction toward the one lateral side, i.e. in the projecting direction of the second stabilizer 33) of the second lock receiving surface 37.

The retainer 80 then is pushed to the full locking position. When the retainer 80 reaches the full locking position, the first locking surface 87 of the retaining body 86 faces and locks to the first lock receiving surface 36 (see FIG. 3). A lateral projecting direction of the first stabilizer 32 and an upward inserting direction of the retainer 80 intersect. Thus, the first locking surface 87 of the retaining body 86 can lock the first lock receiving surface 36 in a long range extending substantially over the entire length along a forming direction (direction toward the one lateral side, i.e. the projecting direction of the first stabilizer 32) of the first lock receiving surface 36.

In this way, the first stabilizer 32 is lockable to the retaining portion 85 of the retainer 80 and the second stabilizer 33 is lockable to the locking projection 68 of the locking lance 67 so that the terminal fitting 10 is retained and held in the cavity 64.

The housing 60 then is connected to the mating housing. When the housings are connected properly, the terminal fitting 10 is connected conductively to the mating terminal fitting. The resilient pieces 19 of the mating connecting portion 15 of the inner conductor 11 resiliently contact the tab of the mating terminal fitting so that a signal current can flow between the terminal fittings. Further, the shield contact pieces 28 of the outer conductor 12 resiliently contact the outer conductor of the mating terminal fitting, and a shield current can flow between the terminal fittings.

As described above, the connector C can achieve the following effects.

The retainer 80 is inserted into the retainer insertion hole 72 of the housing 60 and the retaining portion 85 faces the first stabilizer 32 from behind so that the terminal fitting 10 is prevented from coming out rearward from the cavity 64. The first stabilizer 32 projects out in the terminal fitting 10 so that the flow of the currents can be ensured as compared to the case where the terminal fitting 10 is formed with a recess.

The terminal fitting 10 is connected to the shielded cable W so that a shield current can flow satisfactorily and high frequency performance can be improved by providing the first stabilizer 32 on the coupling 25 separated from the tubular portion 24.

The first stabilizer 32 has a function of guiding the insertion of the terminal fitting 10 and a function of restricting erroneous insertion and is not a part dedicated to receive the retainer 80. Thus, the structure of the terminal fitting 10 needs not be complicated.

Further, the terminal fitting 10 includes the second stabilizer 33 separate from the first stabilizer 32. The locking lance 67 faces the second stabilizer 33 from behind, and is retained in the housing 60 primarily by the locking action of the locking lance 67 for the first stabilizer 32. A lance hole for receiving the locking lance 67 is not open in the terminal fitting 10. Thus, the flow of the currents is not impeded due to the formation of a lance hole, and electrical reliability is enhanced.

The first stabilizer 32 is longer than the second stabilizer 33 in the front-rear direction. Thus, strength sufficient to receive a locking force of the retainer 80 can be ensured. On the other hand, by making the second stabilizer 33 not required to have as much strength as the first stabilizer 32 relatively shorter, the structure of the terminal fitting 10 can be identified and the second stabilizer 33 can conform to the formation position of the locking lance 67 on the side of the housing 60.

The projecting direction of the first and second stabilizers 32, 33 is oriented toward the one lateral side intersecting the vertical direction, which is the inserting direction of the retainer 80 into the retainer insertion hole 72, and the first and second guiding grooves 65, 66 for respectively receiving the first and second stabilizers 32, 33 are recessed toward one lateral side intersecting with the vertical direction in the housing 60. Thus, the housing 60 can be made smaller in the vertical direction and a height of the connector C can be reduced. Further, locking forces between the first stabilizer 32 and the retainer 80 and between the second stabilizer 33 and the locking projection 68 of the locking lance 67 are enhanced.

REFERENCE EXAMPLE

Figure 12:
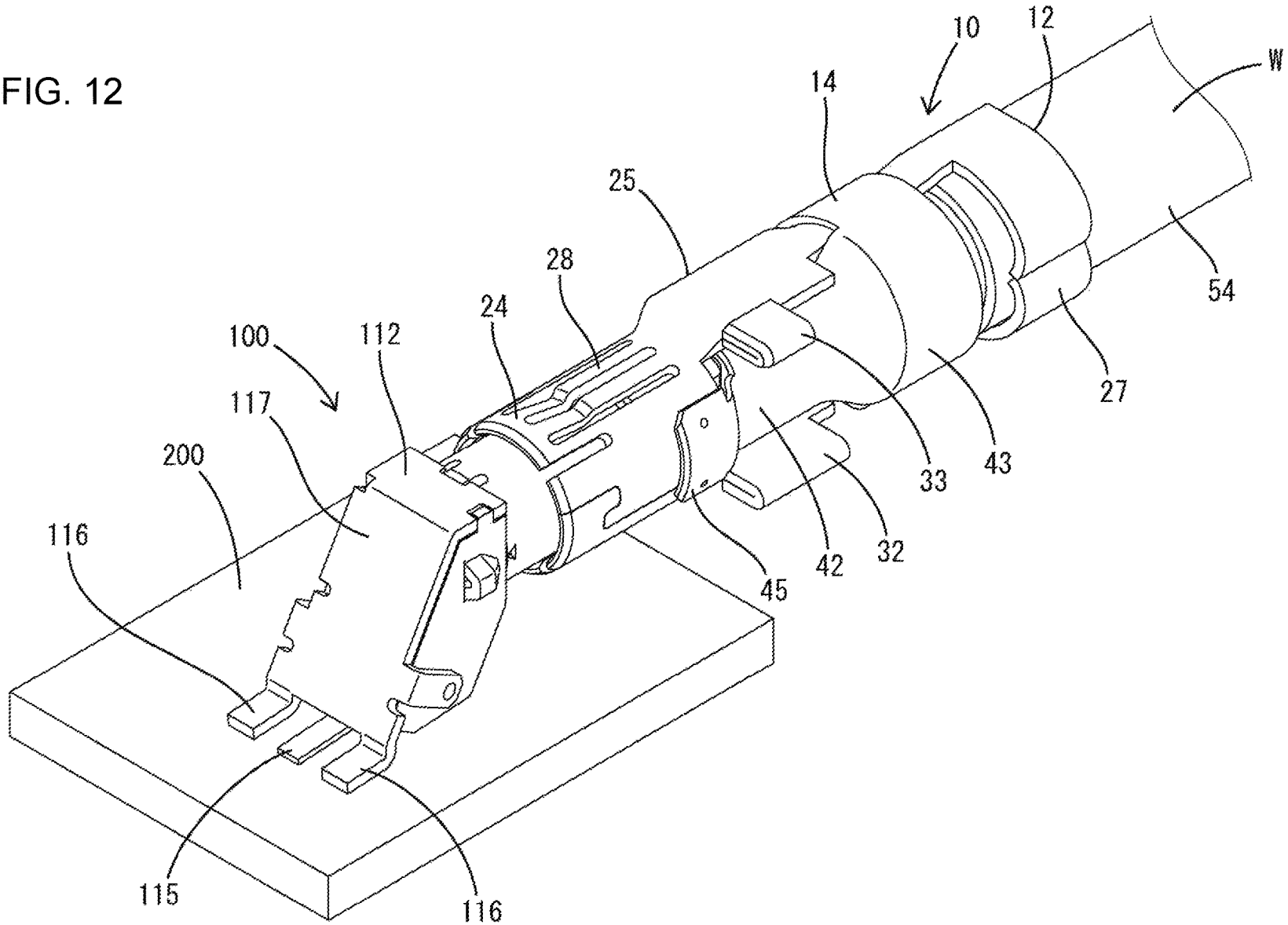
FIG. 12 is a perspective view showing a state where the terminal fitting is connected to a mating terminal fitting on a printed circuit board in a reference example.

FIGS. 12 and 13 show a reference example of a structure for connecting the terminal fitting 10 configured as described above to a mating terminal fitting 100 on a printed circuit board 200 without via the housing 60. Note that, in the following description, ends of the terminal fittings 10, 100 facing each other at the start of connection are referred to as fronts concerning the front-rear direction.

As shown in FIG. 13, the mating terminal fitting 100 includes a mating inner conductor 111 having a tab 110 projecting forward, a box-shaped mating outer conductor 112 for surrounding the periphery (four sides) of the mating inner conductor 111 in all directions, and a mating dielectric 113 provided between the mating outer conductor 112 and the mating inner conductor 111. The mating outer conductor 112 includes a tubular end portion 114 surrounding the tab 110. When the both terminal fittings 10, 100 are connected, the tubular end portion 114 is fit and inserted between the tubular portion 24 of the outer conductor 12 and the dielectric 13, the mating outer conductor 112 is connected electrically to the shield contact pieces 28 of the outer conductor 12 and the tab 110 is electrically connected to the both resilient pieces 19 of the mating connecting portion 15 of the inner conductor 11.

Rear parts of the mating inner conductor 111 and the mating outer conductor 112 are bent with respect to front parts, arranged obliquely to a plate surface of the printed circuit board 200 and connected to the printed circuit board 200 in an inclined state. A connecting piece 115 to be connected to a signal conducive portion of the printed circuit board 200 is provided to extend rearward in the rear part of the mating inner conductor 111. Shield connecting pieces 116 to be connected to a shield conductive path of the printed circuit board 200 extend rearward in the rear part of the mating outer conductor 112. As shown in FIG. 12, the shield connecting pieces 116 project from both sides of the lower end of an inclined back plate 117 in the outer conductor 112. The connecting piece 115 is arranged between the shield connecting pieces 116 paired with respect to the lateral direction.

The terminal fitting 10 is connected to the mating terminal fitting 100 in such a horizontal posture that the first and second stabilizers 32, 33 are facing the one lateral side. Thus, the tubular portion 24, the side walls 29, the shield crimping pieces 39 and the sheath crimping pieces 41 are connected in the front-rear direction on the upper and lower surfaces of the terminal fitting 10 and clearances are covered by the cover 14. The shield contact pieces 28 of the outer conductor 12 are disposed on both upper and lower sides of the terminal fitting 10 and connected to the outer peripheral surface of the mating outer conductor 112 from both upper and lower sides. Thus, a good current path is formed through the upper and lower surfaces of the terminal fitting 10 and the mating terminal fitting 100. In the case of the reference example, the lower shield contact piece 28 is provided to face the printed circuit board 200, wherefore a shield current can flow along a shortest route without waste.

Other embodiments are briefly described below.

The terminal fitting may be a general terminal with no conductive part for shielding.

The second stabilizer may be omitted from the terminal fitting 10.

The terminal fitting may be a male terminal fitting with a tab projecting forward.

The retainer may be of a rear type to be mounted into the housing from behind.

LIST OF REFERENCE SIGNS

C . . . connector
W . . . shielded cable
10 . . . terminal fitting
11 . . . inner conductor
12 . . . outer conductor
14 . . . cover
24 . . . tubular portion
25 . . . coupling
26 . . . shield crimping portion
32 . . . first stabilizer
33 . . . second stabilizer
60 . . . housing
64 . . . cavity
67 . . . locking lance
72 . . . retainer insertion hole
80 . . . retainer
85 . . . retaining portion

What is claimed is:

1. A connector, comprising:

a housing including a cavity extending in a front-rear direction, a retainer insertion hole intersecting and communicating with the cavity and open in an outer surface and a resiliently deflectable locking lance projecting into the cavity;

a terminal fitting to be inserted into the cavity from behind, the terminal fitting having opposite front and rear ends, a tubular portion at the front end, a cable connecting portion at the rear end and a coupling extending between the tubular portion and the cable connecting portion, first and second stabilizers projecting out in a common direction from opposite first and second side walls of the coupling and configured to guide an insertion into the cavity and to restrict the insertion in an erroneous posture, the second stabilizer being disposed to be engaged from behind by the locking lance when the terminal fitting is inserted completely into the cavity; and a retainer to be inserted into the retainer insertion hole, the retainer including a retaining portion configured to face the first stabilizer from behind.

2. The connector of claim 1, wherein the first stabilizer is longer than the second stabilizer in a front-rear direction.

3. The connector of claim 1, wherein the common projecting direction of the first and second stabilizers intersects an inserting direction of the retainer into the retainer insertion hole.

4. The connector of claim 1, wherein:

the terminal fitting includes an inner conductor having a mating connecting portion to be connected to a mating terminal fitting and a center conductor crimping portion to be crimped to a center conductor of the cable, and an outer conductor having the tubular portion configured to surround the mating connecting portion and a shield crimping portion to be crimped to a shield layer of the cable; and the first and second stabilizers are provided at positions separated from the tubular portion on the outer conductor.

5. The connector of claim 4, wherein the center conductor crimping portion disposed inside the coupling, and the connector further comprises a cover configured to electrically contact the outer conductor while covering the center conductor crimping portion, at least part of the cover being disposed in a space inside the coupling.

6. The connector of claim 4, wherein the outer conductor is formed from a single metal plate.

7. The connector of claim 2, wherein a surface of the first stabilizer that faces the retaining portion of the retainer is rearward of a surface of the second stabilizer that is engaged by the locking lance.

8. The connector of claim 1, wherein each of the first and second stabilizers includes an inner plate extending continuously from the respective first and second side walls of the coupling and an outer plate folded from a projecting end of the respective inner plate and disposed in face to face contact with the respective inner plate.

* * * * *